United States Patent [19]

Farrar et al.

[11] 4,174,780

[45] Nov. 20, 1979

[54] FEEDING CIGARETTES AND SIMILAR ROD-LIKE ARTICLES

[75] Inventors: David J. Farrar; Robert W. Davies; David C. M. Carter; Reginald C. Bolt; Robert E. Williams, all of London, England

[73] Assignee: Molins Limited, London, England

[21] Appl. No.: 917,437

[22] Filed: Jun. 20, 1978

[30] Foreign Application Priority Data

Jun. 30, 1977 [GB] United Kingdom ..... 27509/77

[51] Int. Cl.[2] ..... B07C 5/00; B07C 5/344

[52] U.S. Cl. ..... 209/536; 209/546; 209/557

[58] Field of Search ..... 209/535, 536, 537, 546, 209/548, 549, 702, 703, 557; 131/25; 53/54, 78, 151

[56] References Cited

U.S. PATENT DOCUMENTS

| | | | |
|---|---|---|---|
| 3,207,308 | 9/1965 | Kemp | 209/535 |
| 3,785,487 | 1/1974 | Spencer | 209/535 |

*Primary Examiner*—Allen N. Knowles
*Attorney, Agent, or Firm*—John C. Smith, Jr.

[57] ABSTRACT

A cigarette hopper, especially for a packing machine, has a number of flow channels (6) incorporating restraining devices to arrest cigarettes which are faulty, e.g. in size, shape or orientation, thereby preventing the formation of defective cigarette bundles. The lower ends of the channels (22) may be curved to catch non-horizontal cigarettes (C3), and may include photo-cell devices (FIG. 3) which detect and arrest inadequately filled cigarettes and which additionally serve to monitor the flow of cigarettes so that the machine operator can receive a fault warning.

11 Claims, 4 Drawing Figures

FEEDING CIGARETTES AND SIMILAR ROD-LIKE ARTICLES

This invention is concerned with improvements in feeding cigarettes and similar rod-like articles, in particular in the feed of such articles through hoppers.

In the general production and handling of cigarettes and similar articles, it is often necessary to provide a storage hopper into which the articles are supplied, often at irregular intervals, so that the articles may be withdrawn from the base of the hopper at a regular rate. Since similar considerations apply to cigars, filter plugs and similar rod-like articles, reference to any such articles will hereinafter, for the sake of convenience, merely be made to "cigarettes".

As an example, in the packaging of cigarettes, a quantity of cigarettes may be supplied into a hopper from a tray, and the cigarettes then pass down the hopper through vanes, at the base of which they are discharged by a plunger mechanism in groups or batches of a predetermined number, say 20 cigarettes at a time. The groups are then passed on to be wrapped and packed. If for any reason there is a faulty or missing cigarette in a group, this is then detected and the defective group is subsequently rejected. Clearly it is desirable to minimise the formation of such defective groups. In the case of a blockage of cigarettes in one of the vanes at the base of the hopper, the operator of the packing machine may receive a warning of such a fault. However with the high operating speeds of such machinery it is often too late by the time the operator is able to take any corrective action.

According to this invention a cigarette feeding apparatus comprises a discharge device through which cigarettes are to be discharged at a predetermined rate, and a restraining device upstream of said discharge device through which the cigarettes pass before reaching the discharge device, said restraining device being defined by a plurality of flow channels which are together capable of passing cigarettes at a rate greater than said predetermined rate, each channel having arresting means to arrest any cigarette having at least one class of fault which is likely to cause the cigarette to fail to pass through the discharge device or any other part of the feeding apparatus or which will cause the cigarette to be ejected (possibly along with others) at a later stage.

The faults in the cigarettes which are intended to be covered by the expression "class(es) of fault" include cigarettes which are incorrectly oriented, overside or bent cigarettes, or cigarettes in which the ends are inadequately filled with tobacco.

With this arrangement, instead of a faulty cigarette proceeding to the discharge device, where its presence could (e.g. if the cigarette has an overlarge diameter or is bent) obstruct the discharge device and possibly require the whole machine to be stopped, it is held up in and of the channels of the restraining device, and the discharge device can continue to receive an adequate flow of cigarettes via the other channels of the restraining device; the machine operator can later at his leisure remove the faulty cigarette.

The restraining device may be incorporated in a cigarette hopper constituting a cigarette buffer between the restraining device and the discharge device. Thus if one or more of the flow channels is blocked by a faulty cigarette then cigarettes from the buffer can continue to flow for a short while to allow the machine operator (prompted possibly by a warning signal) to extract the faulty cigarette which is blocking the flow channels in the restraining device, The restraining device may comprise a plurality of downwardly directed vanes defining between them flow channels of a width corresponding to the thickness (e.g. the diameter) of the cigarettes and constituting said arresting means. Thus if a cigarette has the fault of being incorrectly oriented, with its axis horizontal and at an angle to the sides of the vanes, then it cannot enter a passage and will be held up across the top of the vanes.

The vanes may be curved, preferably at their lower ends, so that if a cigarette is faulty, in that it enters a passage between adjacent vanes with its axis non-horizontal, it cannot pass the curved portion of the passage.

A measuring device may be provided in each, or a selected number, of the passages to monitor the flow of cigarettes in the passage. The measuring device may comprise a photo-sensitive detector, e.g. a photo-cell; if all passages are monitored the detectors may also be arranged to detect inadequately filled cigarette ends. The resulting fault signal produced by the photo-cell may be used to activate a suction device in the respective passage to hold up such a faulty cigarette.

Where the flow of cigarettes through at least a respresentative selection of passages is monitored, a fault signal may be emitted when a predetermined number of passages are obstructed. In this manner obstructed passages may be cleared, for example manually by an operator, before the total flow through the clear passages becomes less than the discharge rate of cigarettes from the base of the hopper.

An example of a hopper which embodies the invention will now be described with reference to the accompanying drawings, in which.

Figures 1, 2, 3, 4:
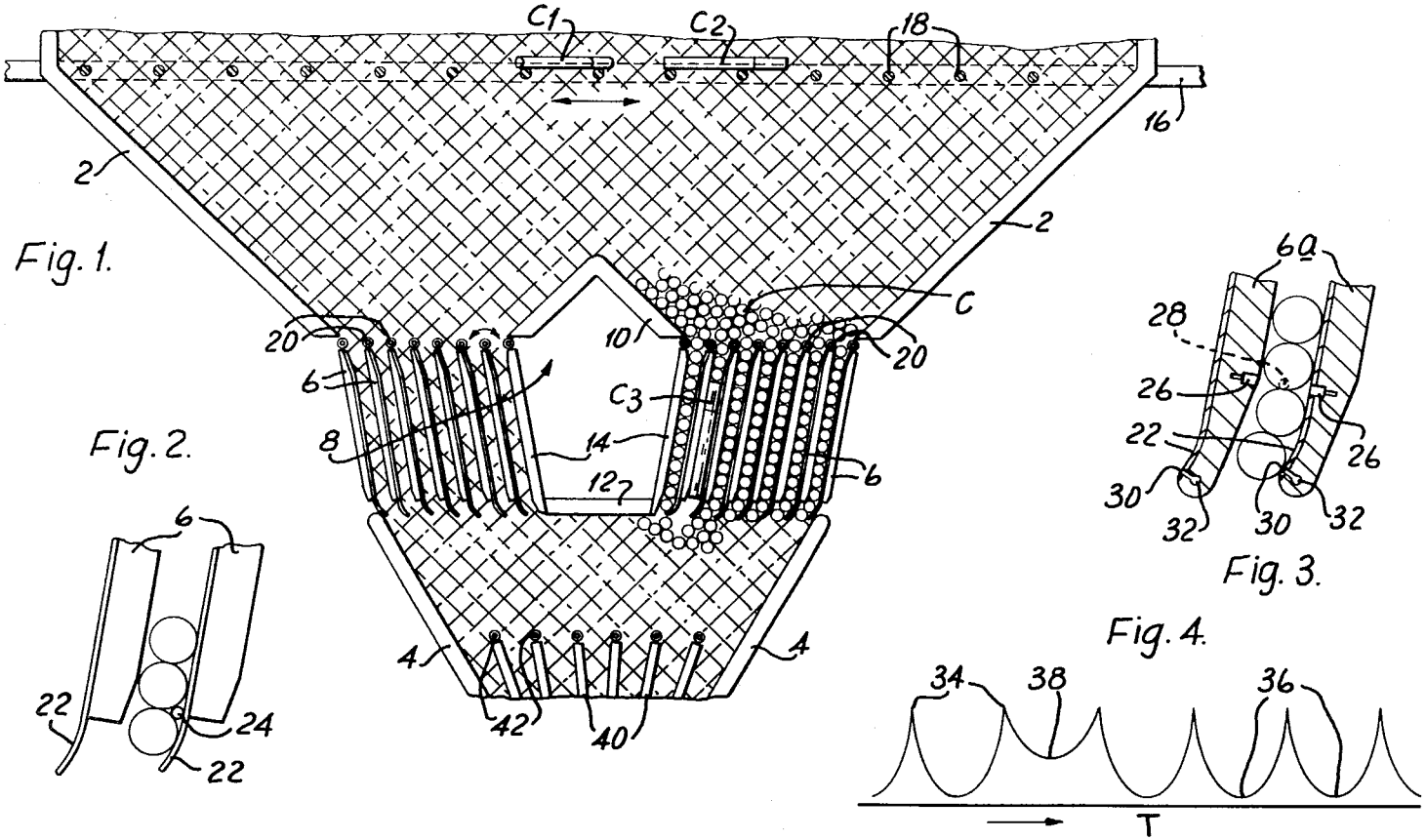
FIG. 1 is a front view of the hopper.
FIG. 2 is a detailed view of a part of FIG. 1 drawn to a larger scale.
FIG. 3 is a modification of FIG. 2.
FIG. 4 is a trace of the output signal from a device of FIG. 3.

The hopper shown in FIG. 1, which is of a type associated with a packing machine, is shown filled with filter-tipped cigarettes C with their axes perpendicular to the plane of the drawing.

The hopper has a pair of upper convergent walls 2 and a pair of lower convergent walls 4. Between the upper and lower walls are two sets of vanes 6 having smooth surfaces so that cigarettes of correct diameter can pass freely down flow channels or passages formed between adjacent vanes. Between the two sets of vanes is a flow splitter body, indicated generally at 8. The body has an upper member 10 of inverted V-shape and a lower member 12 of U-shape, whose limbs are downwardly convergent and constitute further vanes 14.

Towards the top of the hopper is a horizontal body 16 of the shape of a ladder having rungs 18 perpendicular to the plane of the drawing. The distance between adjacent rungs is about half the length of a cigarette. The ladder 16 is reciprocated horizontally by any suitable drive means, for example at a rate of 30 cycles per minute and at a stroke of about 40 mm. Thus a cigarette C1 or C2 lying at an angle to its correct orientation will be held up across a pair of adjacent rungs 18, and the reciprocating motion of the ladder 16 will tend gradually to rotate such a crossed cigarette until it assumes the correct orientation of the other cigarettes.

However, if any cigarette remains permanently in the crossed position so as to block the flow channel between one pair of adjacent rungs 18, there are enough unrestricted flow channels between the other rungs to allow a sufficient flow of cigarettes; therefore the crossed cigarette can be removed by the operator at his leisure. There may be one or more additional ladder-like bodies like the body 18 (either fixed or reciprocating) with a decreasing rung spacing for successive lower ladders.

Extending along the upper edge of each vane 6 is a roller 20, to which a rotary oscillation is continuously imparted so that cigarettes above the roller are urged to one side or the other of the respective vane. Oscillation of the roller 20 also assists in correctly orienting any cigarettes which are still at an angle to the other cigarettes after passing the rungs 18 of the ladder.

Mounted between the walls 4 and spaced below the vanes 6 there can be seen the tops of six convergent vanes 40. Together with the walls 4 the vanes 40 define flow channels down which cigarettes pass into a discharge device (not shown) of the packing machine, where batches of say 20 cigarettes are formed by a plunger mechanism (not shown) which successively pushes out batches of cigarettes axially at the base of the hopper. Above each vane 40 is an oscillation roller 42 similar to each roller 20.

Referring now also to FIG. 2, which shows the lower ends of a pair of adjacent vanes 6, it can be seen that the left-hand side of each vane is formed with a downward extension 22 which curves toward the left, as viewed in FIG. 2. The extensions of the set of vanes which are disposed to the left of the body 8 are, conversely, curved towards the right.

If a cigarette should enter the flow channel or passage between two adjacent vanes 6 in a vertical orientation, as shown by cigarette C3 (FIG. 1), then the curved extension 22 arrests such a disoriented cigarette and prevents it passing down the flow channels of the batch-forming vanes 40, where serious damage could otherwise result at the plunger mechanism (not shown).

As the width of each passage is arranged to be only slightly greater than the diameter of the cigarettes, any cigarette or unacceptably large diameter, of malformed section, or which is bent or has a loose wrapper or uniting band, will similarly tend to be arrested in the passage.

It should be noted that the vanes 6 form a total of fourteen flow channels or passages, whereas the discharge device formed by the batch-forming vanes 40 of the hopper define seven flow channels. Therefore a plurality of passages between the vanes 6 (theoretically up to seven) can be blocked without starving the batch-forming device associated with the vanes 40. Furthermore, the spacing between the vanes 6 and 40 constitutes a smaller buffer store which provides the machine operator additional time to clear the blockage before the batch-forming device becomes starved.

In the vicinity of the curved extension 22 (FIG. 2) there is a small light source 24. This light source, which may take the form of a light emitting diode, is disposed at the back of the passage, as viewed in FIG. 2, so that the rear ends of cigarettes just pass clear of the light source. At a corresponding position at the front of the passage is a photo-cell (not shown) or other light detector. The light source 24 is so spaced from the adjacent vane that it can transmit a beam of light, parallel to the axes of the cigarettes, along the generally triangular space adjacent successive cigarettes whenever such a space comes into alignment with the light source 24. The light beam is detected by the photo-cell, thus producing an impulse after each cigarette which passes the light source. The impulses are fed to a monitoring device which emits a signal if the impulses cease, and possibly also if the frequency of the impulses falls below a predetermined value. Such a signal may be used to warm an operator attending the packing machine that there is a blockage in or above a certain passage, for example because of a vertically oriented cigarette such as C3. The operator can then clear this blockage by hand, without needing to shut down the machine. The monitoring device may also incorporate a counter to display the number of cigarettes which pass a particular light source 24 in a given time.

It may not be necessary to have a photo-cell and a light source 24 in each passage. If the number of vanes is sufficiently large, relative to the rate at which cigarettes are being extracted from the base of the hopper, then it may be possible to monitor only every other passage, for example. Generally this would be acceptable if the probability of there being a blockage in every non-monitored passage is, statistically, so small that it can be dismissed.

FIG. 3 shows a modification of the vanes and of the monitoring arrangement of FIG. 2, which can also be used to detect cigarettes whose ends are faulty. Mounted within adjacent vanes 6A at oppositely disposed postions toward the front of each passage, there are two light sources 26 similar to the light source 24. It should be noted that in contrast to the vanes 6 of FIG. 2, the vanes 6A have solid curved extensions 22A. The light source may be positioned about 2 or 3mm behind the front end (i.e. the tobacco portions end) of a cigarette disposed across the light sources. A photo-cell 28 or other light detector (shown dotted) is disposed midway across the front of the passage, so that it is directed towards and closely spaced from the front end of a cigarette passing the two light sources 26. The arrangement operates in a manner similar to that described in German application No. OS 2,653,298 published June 2, 1977. That is to say, beams of light (preferably pulsed, e.g. at a frequency of 100 Hz) are emitted by the sources 26, and if a cigarette with a good end (i.e. sufficiently filled with tobacco) passes the light sources, then the beam of light will be absorbed by the cigarette and substantially less light received by the photo-cell 28. On the other hand, if the front end of the cigarette is inadequately filled with tobacco, a larger quantity of light will be received by the photo-cell, indicating a faulty cigarette.

FIG. 4 shows the output of the photo-cell 28, or other light detector, plotted on a time base T. So long as cigarettes are moving past the detector, the output will be a succession of peaks 34 and troughs 36, 38. The centres of the troughs occur when successive cigarettes lie exactly between the light sources 26, while the intervening peaks occur as a result of refelection of light to the cell 28 from the other surface of the cigarettes. To detect the presence of an inadequately filled cigarette end, as indicated by the trough 38, use can be made of a logic circuit (of a type of known in the art) which ignores the peaks and responds to the output of the cell 28 represented by the bottom of each trough. Thus an inadequately filled cigarette end will produce a higher output than a good cigarette end, as shown by the difference in level between the trough 38 and the normal troughs 36. The logic circuit may also serve as a flow detector by producing a warning signal when the regular occurrence of peaks and troughs ceases.

If desired a similar pair of light sources and a photocell, as above described, may also be provided at the rear of each passage. Thereby short cigarettes, or ones having a defective mouthpiece end (e.g. a filter missing) may also be detected.

Towards the bottom end of the curved extension 22A of each vane 6A are a group of aligned ports 30 (FIG. 3) connected by a duct 32 to a source of suction. When a faulty cigarette is detected by the photo-cell 28, suction is applied to the ports 30 to hold up the faulty cigarette, which can then be removed manually, Alternatively, provision may be made for automatically ejecting such cigarettes, e.g. by pneumatic means for blowing the cigarette axially out through an opening (not shown) at the rear of the hopper, or by means of a mechanically operated pusher.

Though the above hopper has been described with reference to a packing machine, it is to be understood that the invention is equally applicable to other machines, for example hoppers for multiple length filter plugs in plug assembling machines, or generally in cigarette handling machines.

We claim:

1. Cigarette feeding apparatus comprising a discharge device through which cigarettes are to be discharged at a predetermined rate, and a restraining device upstream of said discharge device through which the cigarettes pass before reaching the discharge device, said restraining device being defined by a plurality of flow channels which are together capable of passing cigarettes at a rate greater than said predetermined rate, each channel having arresting means to arrest any cigarette having at least one class of fault.

2. Apparatus as claimed in claim 1 in which said restraining device comprises a plurality of downwardly directed vanes defining between them flow channels of a width corresponding to the thickness, e.g. diameter, of the cigarettes and constituting said arresting means.

3. Apparatus as claimed in claim 2 in which the lower ends of the vanes are curved, so that non-horizontal cigarettes are arrested in the flow channels.

4. Apparatus as claimed in claim 2 in which a measuring device is provided in at least a selected number of said flow channels to monitor the flow of cigarettes therethrough.

5. Apparatus as claimed in claim 4 in which said measuring device comprises a photo-sensitive detector disposed at a lateral end of each flow channel and capable also of detecting cigarette ends which are inadequately filled.

6. Apparatus as claimed in claim 5 further comprising a suction port disposed at the lower end of each flow channel, said port being activatable by said detector to arrest a faulty cigarette detected thereby.

7. Apparatus as claimed in claim 2 in which said restraining device further comprises a horizontal ladder disposed above said downwardly directed vanes, said ladder comprising regularly spaced rungs defining between them flow passages, and means to reciprocate said ladder horizontally, the spacing between adjacent rungs being greater than the diameter of the cigarettes but smaller than the length of the cigarettes.

8. Apparatus as claimed in claim 1 further comprising a buffer provided between said restraining device and said discharge device to allow cigarettes to continue flowing to said discharge device if a large number of flow channels are blocked.

9. Apparatus for feeding cigarettes to a discharge device having a plurality of passages, comprising a hopper, channel means defining a plurality of flow channels greater in number than said passages, said channel means being disposed across said hopper and spaced from the entry to said passages, and arresting means associated with each said flow channel for arresting a cigarette which is disoriented or faulty.

10. Apparatus as claimed in claim 9 in which each said flow channel is defined by a pair of downwardly directed vanes, at least one of said pair of vanes comprising a curved lower end, the width of said flow channels corresponding to the diameter of the cigarettes.

11. Apparatus as claimed in claim 10 further comprising a flow divider disposed in the middle of said plurality of vanes, the vanes at one side of the flow divider being convergent relative to the vanes at the other side thereof.

* * * * *